US005148921A

United States Patent [19]

White

[11] Patent Number: 5,148,921

[45] Date of Patent: Sep. 22, 1992

[54] PNEUMATIC SEPARATION OF PARTICULATE MATERIAL

[75] Inventor: Victor A. M. White, Buckingham, England

[73] Assignee: GBE International PLC, Andover, England

[21] Appl. No.: 623,814

[22] PCT Filed: Jul. 7, 1989

[86] PCT No.: PCT/GB89/00774

§ 371 Date: Feb. 27, 1991

§ 102(e) Date: Feb. 27, 1991

[87] PCT Pub. No.: WO90/00445

PCT Pub. Date: Jan. 25, 1990

[30] Foreign Application Priority Data

Jul. 8, 1988 [GB] United Kingdom ..... 8816342
Aug. 17, 1988 [GB] United Kingdom ..... 8819583

[51] Int. Cl.[5] ..... B07B 9/00

[52] U.S. Cl. ..... 209/20; 209/466; 209/467; 209/486; 209/493; 209/494; 209/506

[58] Field of Search ..... 209/466, 467, 486, 490, 209/493, 494, 502, 504, 506, 20

[56] References Cited

U.S. PATENT DOCUMENTS

| | | | |
|---|---|---|---|
| 1,315,880 | 9/1919 | Sutton et al. | 209/467 |
| 2,006,119 | 6/1935 | Steinmetzer | 209/504 X |
| 2,028,904 | 1/1936 | Haworth | 209/502 X |
| 2,803,346 | 8/1957 | Weston et al. | 209/502 |
| 4,294,693 | 10/1981 | Brennan | 209/466 |
| 4,913,804 | 4/1990 | Muller | 209/466 X |
| 5,087,351 | 2/1992 | Valentine, Sr. | 209/20 |

*Primary Examiner*—Michael S. Huppert
*Assistant Examiner*—Joseph A. Kaufman
*Attorney, Agent, or Firm*—Dowell & Dowell

[57] ABSTRACT

The invention relates to apparatus for the pneumatic separation of particulate material particularly but not solely for the separation of objectionable material such as stem from cut lamina or cut rolled stem tobacco (CRS). Apparatus for the pneumatic separation of particulate material comprises a substantially horizontal vibrating conveyor having a plurality of grooves having apertures (14) through which air passes to partially or wholly fluidize the material under treatment.

18 Claims, 5 Drawing Sheets

PNEUMATIC SEPARATION OF PARTICULATE MATERIAL

The invention relates to apparatus for the pneumatic separation of particulate material particularly by not solely for the separation of objectionable material such as stem from cut lamina or cut rolled stem tobacco (CRS).

In the tobacco industry such products are unthreshed tobacco, threshed tobacco, cut dried stem, cut dried lamina, cut tobacco generally in the primary process, in the feed systems to cigarette makers and within the makers.

It is well known in the tobacco industry to use a vertical upward flow of air to separate tobacco particles of differing terminal velocity, into two fractions. The particles with terminal velocity below that of the air (lights) being carried upward by the air stream and those with terminal velocity above that of the air (heavies) falling downwardly against the air stream, the particle fraction being adjusted by the air velocity.

The unseparated particles are normally thrown horizontally into the air stream by a winnower. The light particles carried upwardly are removed from the air by a tangential separator (e.g. cyclone) or screen separator and the heavy particles are dropped out through a chute, preferably with an air lock.

Typically the screen separator contains a screen through which air but not desired product can pass and also an airlock in the form of a paddle wheel assembly. The tangential separator also has an airlock of paddle type. In either arrangement the rotation of the paddle wheel limits air interchange and allows the product to be discharged.

Product size degradation can be caused by impaction against the screen, material sliding across the screen, by abrasion and chopping within the paddle wheel. Degradation can also occur by impaction and abrasion in the conveying tube.

The heavy particles may instead fall on to a horizontal gauze screen in the air stream which is vibrated in the manner of a jigging conveyor to convey the particles out of the air stream. The vibrating screen can also be used to feed the unseparated particles into the air stream.

To provide an accurate classification it is clearly important to have an air flow of uniform velocity. In one form of the equipment this is achieved by adjustable air guides below the gauze screen. In another the gauze screen is replaced by a perforated diffusion plate with fine holes.

The plate has a low percentage free area of typically 2.5% and builds up enough pressure on its under side to diffuse the air uniformly.

Tobacco leaf comprises thin lamina and a relatively thick mid-rib (known as stem) and veins which are structural and vascular. These are separated during manufacture by a threshing process into mid-rib and lamina with veins and then processed separately including cutting or shredding.

The cutting of mid-rib or stem produces some stick-like pieces or slivers, which when made into cigarettes can penetrate the paper tube. These can be effectively separated by the known methods described above, usually following drying, where the separating air also cools the tobacco.

The cutting of the lamina also produces some slivers partly from the 1 or 2% of stem which has not been separated from lamina, but also from the veins and tip of the mid-rib which are not separated by threshing.

The cigarette making maching is fitted with a winnower to remove these slivers but is only 75% successful. It is desirable to remove these slivers before they reach the making machine.

In some parts of the world the leaf is hand cut by the farmer before it reaches the cigarette manufacturer. The cut is at right angles to the stem, so the strands of cut lamina include a cross section of the stem known as a 'birds eye'. This is broken away from the cut lamina by the carding drums in the cigarette maker to produce an undesirable drop out from the cigarette.

It is possible to break the birds eyes from the cut lamina before the cigarette maker by the use of prior carding drums. It then becomes necessary to remove the birds eyes from the cut lamina before they reach the making machine.

A disadvantage of the pneumatic method of separation described above is that the light particles are lifted and conveyed away by the air so that an additional separator is required to remove the particles from the air. If light particles are the majority then large air flows and powers are required to lift and convey them and a large separator is required to separate them from the air.

The pneumatic method described above is successful with cut stem because the particle size is more uniform and granular. It is less successful with cut lamina because the shreds are long and entangled forming clumps which need to be opened to release the heavies.

Another disadvantage of pneumatic separators is that the ability to discriminate between lights and heavies (and therefore to separate them) is poor principally because of difficulties in uniform presentation of the product into the chamber airstream and setting the required air velocity profile and gradients. If the local air velocity exceeds the terminal velocity of the particle it will be entrained; if the local air velocity is less than the terminal velocity of the particle it will not be entrained and will separate from those which are entrained. Terminal velocities vary with the ratio of particle mass to particle size and consequently vary with the shape, size and density of individual particles. The likely range of terminal velocities is given below for two types of CRS.

TABLE 1

| | TYPE | | | | | | | |
|---|---|---|---|---|---|---|---|---|
| | A Terminal | | B Velocity m/sec | | A Velocity | | B Ratios | |
| | min | max | min | max | min | max | min | max |
| Desired lights | 0.7 | 1.1 | 1.0 | 1.7 | 1.0 | 1.57 | 1.0 | 1.7 |
| Non desired heavies | 1.22 | 2.4 | 1.9 | 3.0 | 1.74 | 3.43 | 1.9 | 3.0 |

From these velocities it is evident that a system set to discriminate at 1.15 m/sec for product A would reject as undesirable a substantial proportion of B which should be accepted, while a system set up for product B would incorrectly accept most of the A heavies. Such systems are very sensitive to product type.

In the case of cut rolled stem, a further disadvantage is that adjusting the air velocity to suit the material type changes causes changes in the degree of cooling occurring by altering both the air volume available to absorb heat and the cooling time. Changes in cooling alter the moisture loss during cooling and can cause the cooled product to go outside the permitted moisture limits. In extreme cases the rate of heat and moisture loss from the particle surface may exceed the rate of their transfer from within the particle. This is known as case hardening and causes the material to become temporarily embrittled and more likely to size degrade.

It is an object of this invention to provide means for air separation into heavy and light fractions which does not require a separate separator particularly a pneumatic separator which uses less air and which provides enough vibration to separate heavy particles from clumps.

According to the present invention there is provided apparatus for the pneumatic separation of light and heavy material from particulate material comprising a substantially horizontal tray of sheet material having a plurality of grooves and ridges, said tray having discrete apertures through which air passes from beneath the tray to partially or wholly fluidise the material under separation treatment to form a carpet on the tray, means for simultaneously vibrating the tray to release the light and heavy particles, and means for removing said light and said heavy particles, characterised in that the bottom zone of each groove is in the form of a trough with upstanding sides and the regions of the grooves between the trough extending towards the top of the ridges are inclined to said upstanding sides and said apertures are provided at least in the troughs and are sized and distributed so that together with the groove profile the velocity profile over the surface of the tray is such that the air velocity in the region of the troughs is greater than in the region of the ridges to cause the light particles to rise and the heavy particles to sink from said carpet.

The invention will now be described by way of example with reference to the accompanying drawings in which.

Figure 1A:
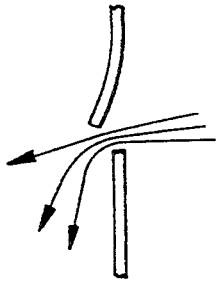
FIG. 1A is an enlarged cross-sectional illustrational showing the air flow through one of the openings 14 shown in FIG. 1.
Figure 3:
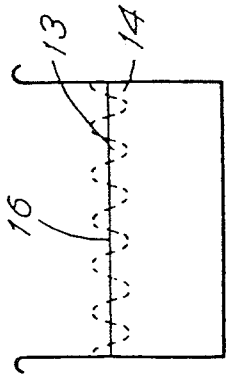
Figure 1:
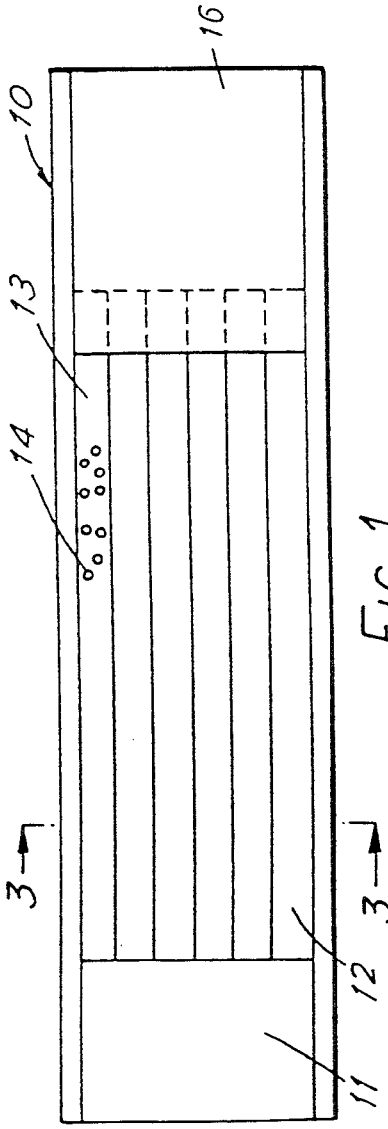
FIG. 1 is a schematic plan view of an embodiment which includes a conveyor having a plurality of perforated grooves and a dividing plate disposed at the plane of separation.
Figure 4:
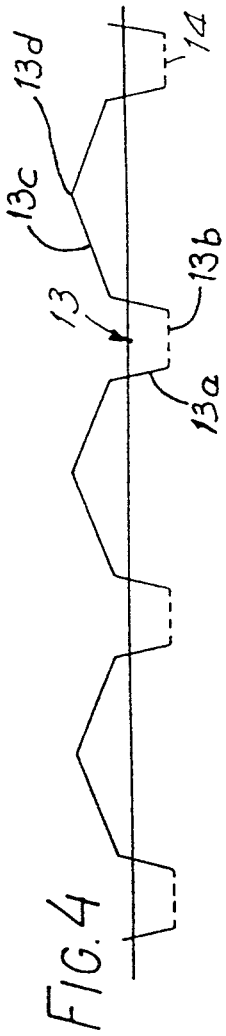
Figure 5:
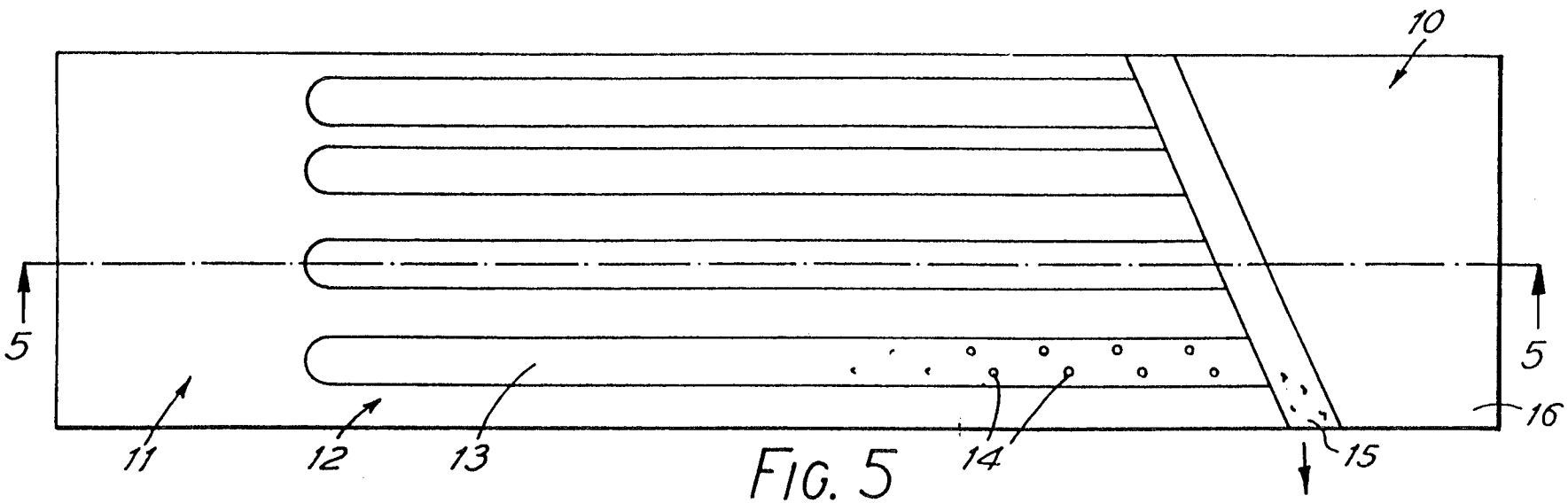
Figure 6:
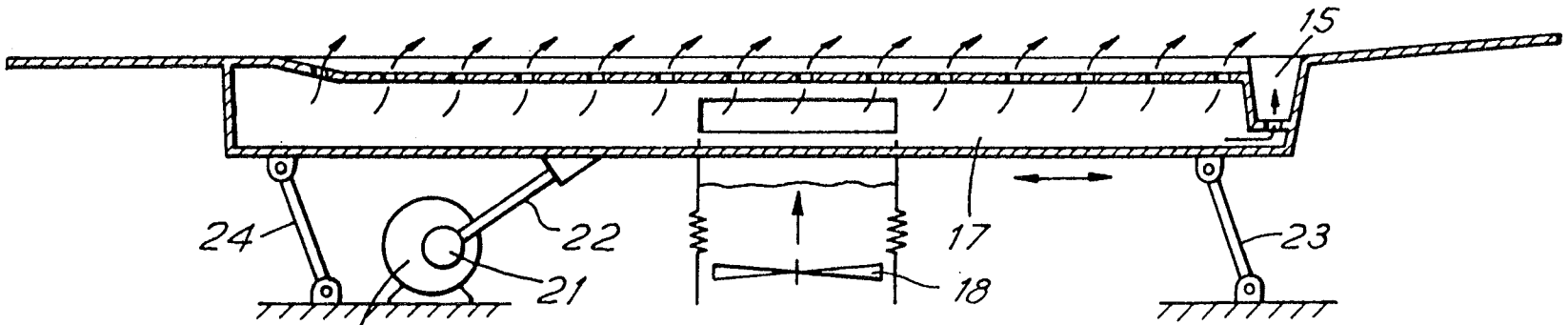
Figure 7:
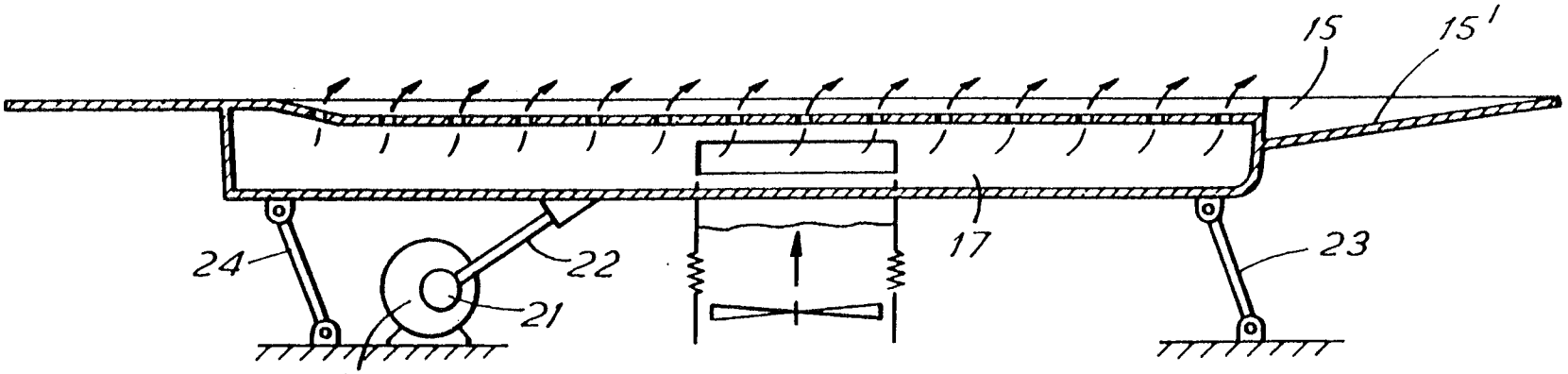
Figure 8:
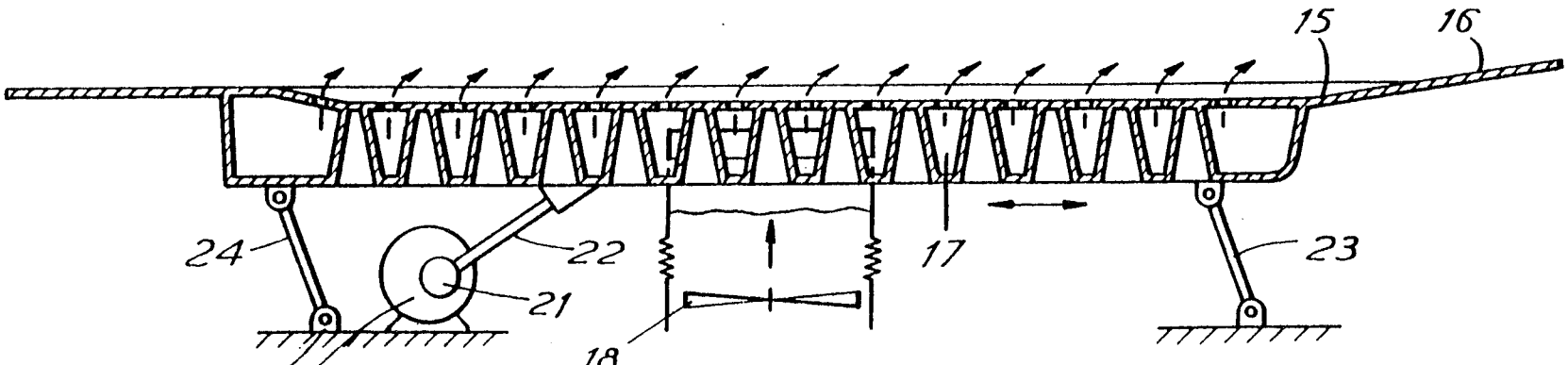
Figure 9:
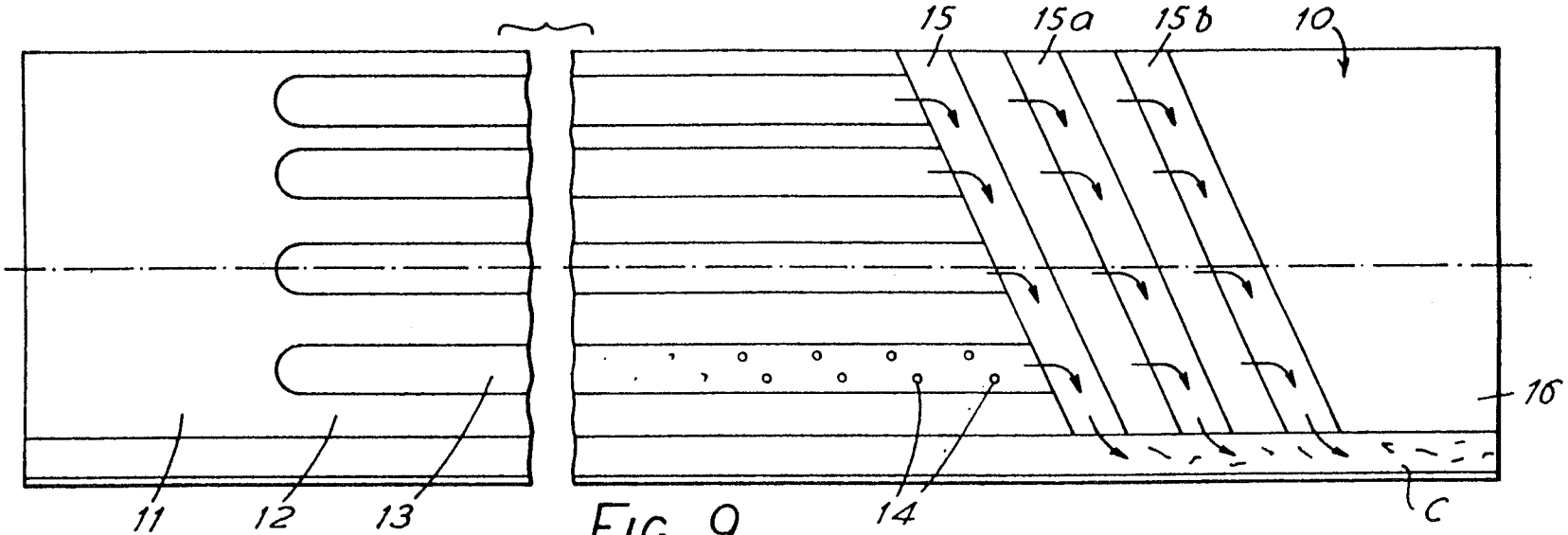
Figure 10:
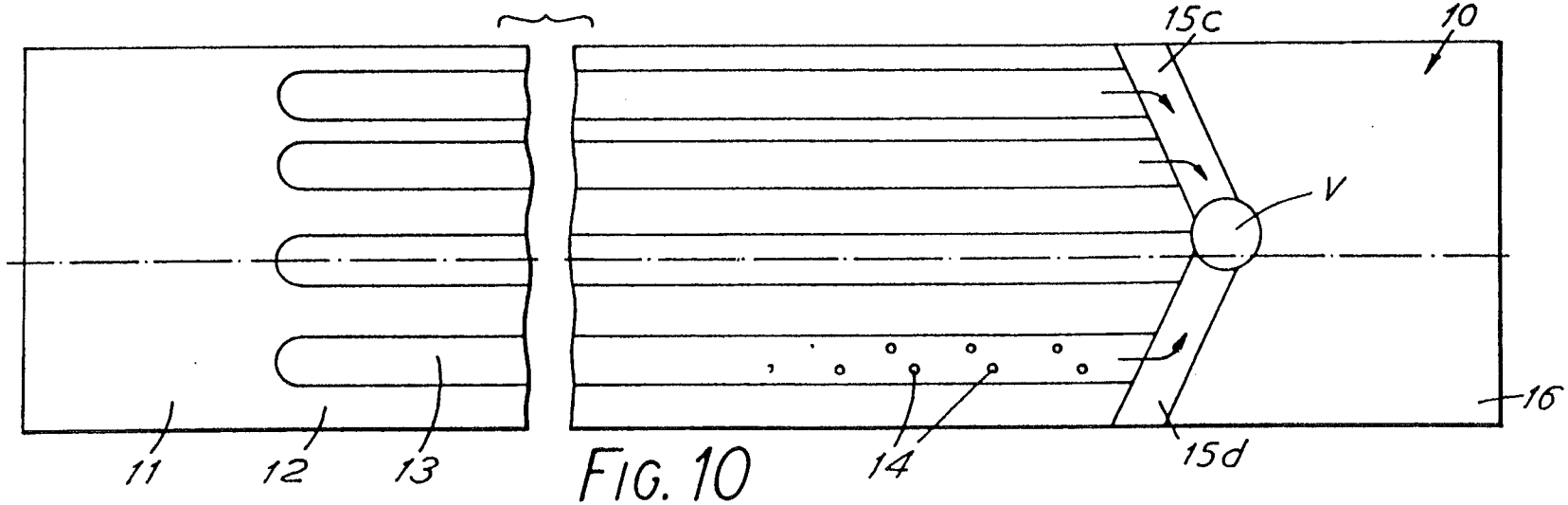
Figure 11:
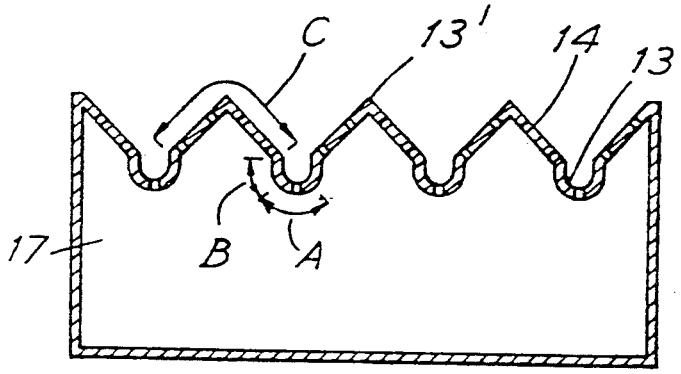

FIG. 3 is a section taken along the line 3—3 of FIG. 1 showing merely schematically the troughs and peaks of the grooves, FIG. 4 is a schematic section taken along the line 3—3 of FIG. 1 with a preferred conveyor section according to the invention, FIG. 5 is a plan view of a vibrating conveyor in a second embodiment having transverse channel at the region of separation, FIG. 6 is a longitudinal section to 5—5 of FIG. 5 of a third embodiment modified by the provision of an inclined imperforate transverse channel instead of a perforated channel, FIG. 7 is a similar longitudinal section to 5—5 of FIG. 5 of a third embodiment modified by the provision of an imperforate transverse channel, having an inclined exit surface, instead of a perforated channel, FIG. 8 is a similar longitudinal section to 5—5 of FIG. 5 of a fourth embodiment modified by the provision of passages extending vertically from the bottoms of the grooves instead of a transverse channel, FIGS. 9 and 10 show yet further forms of vibratory conveyor in schematic plan view, and FIG. 11 is a cross section showing an alternative profile according to the invention.

DESCRIPTION OF PREFERRED EMBODIMENTS

Figure 2:
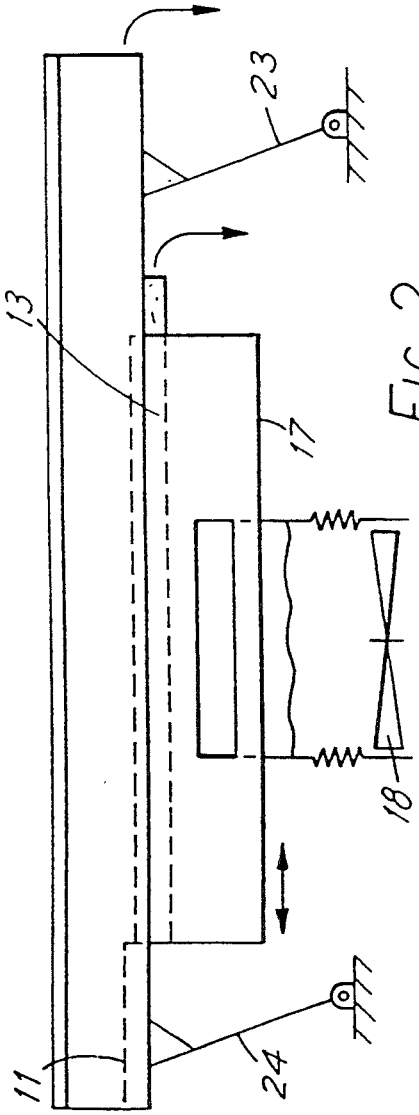
FIG. 2 is a schematic side elevation of said first embodiment.

The separator more suited to cut lamina applications shown in FIGS. 1, 2 and 3 comprising a conveyor 10 over which the material is transported having a delivery region 11 on which the cut tobacco stem is delivered, a rectification region 12 having a plurality of grooves 13 extending in the direction of transport, said grooves having perforations 14 through which air can be forced, and a separation region 15 at which there is disposed a flat plate 16 extending transversely of the direction of transport.

The grooves 13 which run in the direction of conveying are typically 15 mm to 50 mm wide and deep and a are repeated across the full width of the conveyor. The plate 16 lies between the two planes defined by the top and bottom of the grooves and which vibrates with the grooved conveyor. As shown in FIG. 3, the level of the plate 16 is such that a major portion of the ends of the grooves 13 communicate with the region below the plate 16.

A plenum chamber 17 extends for the whole area below the perforated tray and is flexibly connected to a fan 18 to provide the air flow through the conveyor perforations. The purpose of the perforated groove profile is to produce a vertical air flow of diminishing air velocity towards the top of the groove.

The perforations are small, typically less than 1.5 mm diameter and the free area of the holes in the conveyor material is typically less than 2.5%. This creates a pressure below the conveyor which ensures a uniform distribution of the air.

The vibrating conveyor can be of a well known type with inclined tray support links 23, 24 and eccentric drive 21 or with the tray supported on flexible mountings and oscillated by two throw weight motors.

In operation the high terminal velocity slivers or birds eyes separate from the cut lamina and fall to the bottom of the grooves 13 and are conveyed beyond the air stream where they are discharged separately below the flat plate 16. The low terminal velocity cut tobacco remains near the top of the grooves and is conveyed onto the flat plate from whence it is discharged.

The clumps of cut lamina will have a higher terminal velocity and will sit more heavily on the top of the grooves where they are subjected to vibration which will release the heavy material and open the clump.

The flat plate 16 which extends beyond the grooves is preferably adjustable for height relative to the grooves to that the line of separation can be optimised according to the type of material undergoing the separation process. In addition the air flow can be adjusted to give a similar result or to correct for different materials.

The separated slivers of birds eyes, which are high fibre stem, can be re-processed into tobacco sheet for inclusion in later production.

For example in FIG. 4 the grooves have troughs 13 having upstanding sides **13*a* and are flat bottomed 13*b*, only the bottom being perforated. The troughs are contiguous with a low angled section 13*c* which forms a continuation of the groove towards the ridge 13*d***, which ensures that the cut lamina is subjected to vibration when the released heavies slide down the angled section into the grooves.

In the separator of FIGS. 5 and 6, the vibratory conveyor 10 is again provided with a delivery region 11 on which the product is delivered, a separation region 12 having a plurality of grooves 13 extending in the direction of transport, said groove having perforations 14 through which air can be forced, and a separation region 15 which in this embodiment is in the form of a channel extending transversely and obliquely of the direction of the transport.

The conveyor of the embodiment shown in FIGS. 5 and 6 may be modified in accordance with any of the arrangements shown in FIGS. 7–10.

In FIG. 7 the oblique groove 15 which is imperforate, has an inclined exit surface 15'. The heavies are chunky so cannot climb the exit surface and are discharged to one side. The lights form a carpet which can climb the exit surface 15'.

The modification shown in FIG. 8 the collection groove 15 has been omitted and instead conical tubes 17' are provided which communicate with the bottoms of the grooves and pass through the plenum chamber 17. The heavies pass through the tubes and may be collected on a tray (not shown) disposed beneath the plenum chamber.

Beneath the transport surface at least in the region of the grooves 13 is a, or a series of, plenum chambers 17 which supply air or other gaseous fluid to the separation region and collection groove 15.

The arrangement of the grooved separation region collection groove and discharge exit surface 15' may be repeated sequentially.

The vibratory conveyor therefore includes regions with defined functions. The input receiving region 11 which accepts the incoming product and presents it to the separation region 12. The grooves 13 in the separation region over which the main product flows carry objectionable heavy particles. The collection groove 15 receives material from within the separation grooves, that is material including the objectionable heavies. Material in the collection groove 15 moves along the length thereof to be discharged from the end of the collection groove.

The input area is dimensioned to allow the material to spread out and present uniformly to the separation region.

Alterative embodiments of the conveyor are shown in FIGS. 9 and 10, the former embodiment including a series of transverse and oblique collection grooves 15, **15*a*, 15*b* communicating with a common side channel C and the latter embodiment having two transverse collection channels 15*c*, 15*d*** obliquely arranged respectively in opposite senses and communicating with a central vertical outlet V.

The profiles of the grooved conveyor of any of the embodiments disclosed herein may be flat bottomed with sloping sides (FIG. 4) or may be defined by semicircular troughs 13 having upstanding sides contiguous with side regions of the grooves which regions extend upwardly towards regions 13' as shown in FIG. 12.

The pressure drop of the perforated separation region is preferably high in relation to that of the material above it. Preferably the tray is arranged to provide two thirds of the combined pressure drop of the tray and materials above it.

The groove apertures may be of the cheese grater or rasp type in which the holes in a sheet are formed by displacing metal instead of by punching and in which one side of the hole is raised above the surface of the sheet. This displacement imparts to air passing through the holes a velocity component parallel with the sheet in addition to the normal component at right angles to the sheet. A characteristic of this sheet is that the parallel velocity component only exists near to the sheet surface so that its influence is only felt in the vicinity of the sheet. (See inset Sheet 1)

This type of sheet may be used within the grooves with the parallel velocity component opposing the vibratory conveying action so that the heavies at the bottom of the groove are conveyed by the air in the opposite direction to the lights which are conveyed by the vibratory action in order to separate the heavies from the lights. Since the grooves communicate with the space below the delivery plate 11, the heavies may pass under the plate 11.

In this 'reverse movement' arrangement no separation plate or inclined exit surface is required.

The size and spacing of the perforation holes and the profile of the grooved rectification deck are deliberately arranged so that a preferred relative velocity profile is obtained (FIG. 11). The relative velocity ratio of fluid above zone A should be just below that required to entrain the undesired heavies, that is 1.7 from Table 1. Hence in operation once undesired particles have entered this region the fluid velocity cannot lift them to a higher zone, but any desired lights would be lifted from this region. It is required that undesired heavies can sink through the region above zone B, but that desired lights are mainly lifted out of this region. Hence a velocity ratio of 1.5 could be targeted.

Similarly the velocity in the region over zone C must be such that it does not lift excessively any of the desired lights or undesired heavies; there could be a category of undesired lights such as dust which it would be preferable to remove. Hence a velocity ratio of less than 1.0 is required above zone C.

As shown in FIG. 11 the ridges may be imperforate.

By means of creating velocity profiles the situation is generated where the various materials will tend to concentrate at different levels above the perforated deck according to their aerodynamic characteristics, basically into two levels, undesired heavies at the lower level and desired lights at the higher level.

The vibratory action of the entire unit will also encourage heavies to sink down through the floating mass of lights.

The input material mixture will contain an expected range in the proportion of undesired heavies. This range of expected proportion is taken into account when designing the deck profile and the extent of each perforated zone. These proportions are normally expressed in mass terms and 2 and 5% objectionable heavies by mass would not be untypical in a tobacco cut rolled stem process. However, for this application the proportion range may be expressed in terms of volumetric proportions when in a vibrated situation. This is because the desired and undesired materials have different specific volumes and it is these volumes which are important. If, for example, it is found that the proportion of undesired heavies on a volumetric transport basis is 4 to 10% then the situation in FIG. 12 may be used where the cross sectional area above all zone A regions corresponds approximately to the minimum expected objectionable product volume, while that above A and B corresponds approximately to the maximum expected objectionable product volume. The total volumes and consequently cross sectional areas of the velocity regions A and B correspond approximately to the expected in transit volumes of the undesired heavy materials. As heavies enter these regions they displace any lights which may have been there, this action reduces the consequences of any inaccuracy of relative velocity design and the effects of changes in material type.

By consideration of velocity profiles and material volumes the situation is created by which undesired particles are separated and concentrated. This material eventually enters the collection groove. The collection groove is sized and zones in a similar way to the separation grooves except that the cross sectional area of velocity regions A and B now corresponds to less than maximum but more nearly to the minimum volumetric proportion of undesired heavies. This should take into account the change in transport volume experienced as particles now move across instead of along the deck.

Desired material and excess undesired material move on to the discharge surface. Where applicable the angle of incline of the discharge surface is such that desired material can easily transport up the incline but heavies stay near the base of the incline. If desired the incline may be perforated and zoned to further encourage distinction between desired and undesired materials.

It may be arranged that material leaving the conveyor can enter a subsequent rectification area and this action can be repeated a number of times.

The rectified and concentrated undesired materials in the collection groove may be discharged out of the process line or passed to another rectification deck or special purpose machine.

By means of the above described embodiments separation is achieved which does not necessitate the use of lifting the light fraction by vacuum means resulting in less air being used. A greater emphasis is placed on vibration to separate the heavies.

This treatment is preferably carried out between cutting and drying to minimise degradation, but also as soon as possible after cutting to minimise clumping which occurs as soon as the cut tobacco is mechanically handled.

Such an arrangement as described above may be combined with a distribution system for supplying cut tobacco.

I claim:

1. In an apparatus for the pneumatic separation of light and heavy particles from particulate material including a substantially horizontal tray of sheet material having a plurality of grooves and ridges extending longitudinally thereof, the grooves and ridges having material inlet and exit ends, said tray having discrete apertures through which air passes from beneath the tray to at least partially fluidize the material under separation treatment to form a carpet on the tray, means for simultaneously vibrating the tray to release the light and heavy particles, and means for removing said light and said heavy particles, the improvement comprising, each groove being in the configuration of a trough and having bottom and side walls, said side walls having an upper portion, inclined walls extending from said upper portion of said side walls of the grooves to the uppermost portion of the ridges, said apertures being provided at least in the grooves and being sized and distributed so that when gas is introduced therethrough the velocity profile over the surface of the tray will be such that the gas velocity in the region of the grooves is greater than in the region of the ridges to cause the light particles to rise and the heavy particles to sink from the carpet of material, and the tray having a collection channel extending obliquely and transversely of the grooves and ridges adjacent the exit ends of the grooves.

2. The apparatus according to claim 1, wherein a substantially horizontal plate is provided at the exit ends of the grooves at a level lying between planes defined by the top portion of the side walls and bottom of the grooves and thereby providing a line of separation between light and heavy particles.

3. The apparatus according to claim 2, including means for vertically adjusting said plate relative to the grooves so that separation can be optimized according to the type of particulate material.

4. An apparatus according to claim 1, including a plurality of transverse and oblique collection channels, said channels being parallel to each other.

5. An apparatus according to claim 4, wherein the collection channels communicate with a longitudinally extending channel disposed at one side of the tray for transport of the separated heavy particles.

6. An apparatus according to claim 1, wherein two collection channels are provided which extend respectively obliquely of the direction of material travel and are oppositely oriented relative to each other, each channel communicating with a centrally arranged outlet.

7. An apparatus according to claim 4, including gas feed apertures in said collection channels.

8. An apparatus according to claim 1, including at least one plenum chamber arranged beneath the tray for feeding gas to the apertures.

9. An apparatus according to claim 1, wherein the collection channel extending transversely of the direction of material travel is imperforate and is provided with an inclined exit surface.

10. An apparatus according to claim 1, wherein the bottoms of the grooves are flat.

11. An apparatus according to claim 1, wherein said inclined walls between the grooves and the ridges are imperforate.

12. An apparatus according to claim 1, wherein said inclined walls between the grooves and the ridges are perforated.

13. An apparatus according to claim 1, wherein the bottoms of the grooves are flat and the ridges are angular.

14. An apparatus according to claim 1, wherein the apertures in the grooves are formed by displacing portions of the tray into the grooves whereby on passing gas through the apertures a velocity component parallel with the tray is achieved in addition to a component normal to the tray.

15. An apparatus according to claim 14, wherein the apertures are so arranged that the parallel velocity component is toward the inlet ends of the grooves whereby the heavy particles are conveyed in a direction opposite to that of the light particles.

16. An apparatus according to claim 15, wherein the tray includes a delivery region, the inlet ends of the grooves being open so as to communicate with a space beneath the delivery region.

17. An apparatus according to claim 1, wherein gas to feed the apertures is passed by way of a plenum chamber arranged beneath the tray, said plenum chamber having tubes extending vertically therethrough and communicating with the bottoms of the grooves whereby the heavy fraction can pass from the grooves to the exterior beneath the plenum chamber.

18. An apparatus according to claim 17, wherein the tubes are conical.

* * * * *